US006277534B1

(12) United States Patent
Foltz et al.

(10) Patent No.: US 6,277,534 B1
(45) **Date of Patent: *Aug. 21, 2001**

(54) MULTIPLE-SEAM ELECTROSTATOGRAPHIC IMAGING MEMBER AND METHOD OF MAKING ELECTROSTATOGRAPHIC IMAGING MEMBER

(75) Inventors: Robert S. Foltz, Rochester; Richard P. Millonzi, Webster; Robert C. U. Yu, Webster; John J. Darcy, Webster; Edouard E. Langlois, Irondequoit, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/699,509

(22) Filed: Oct. 31, 2000

Related U.S. Application Data

(62) Division of application No. 09/449,342, filed on Nov. 24, 1999, now Pat. No. 6,197,461.

(51) Int. Cl.[7] ..... G03G 5/04

(52) U.S. Cl. ..... 430/56; 430/127; 430/130; 430/69; 156/73.4; 156/189; 156/266; 156/304.6

(58) Field of Search ..... 430/56, 69, 127, 430/130; 428/58, 57; 399/162; 156/734, 137, 157, 189, 256, 304.1, 304.5, 304.6, 266, 98, 94

(56) References Cited

U.S. PATENT DOCUMENTS

| | | | |
|---|---|---|---|
| 3,121,006 | 2/1964 | Middleton et al. | 430/51 |
| 3,442,781 | 5/1969 | Weinberger . | |
| 3,972,717 | 8/1976 | Wiedemann . | |
| 4,233,384 | 11/1980 | Turner et al. | 430/72 |
| 4,265,990 | 5/1981 | Stolka et al. | 430/96 |
| 4,286,033 | 8/1981 | Neyhart et al. | 430/60 |
| 4,291,110 | 9/1981 | Lee | 430/60 |
| 4,299,897 | 11/1981 | Stolka et al. | 430/73 |
| 4,302,521 | 11/1981 | Takei et al. | 430/81 |
| 4,306,008 | 12/1981 | Pai et al. | 430/85 |
| 4,338,387 | 7/1982 | Hewitt | 430/86 |
| 4,415,639 | 11/1983 | Horgan | 430/64 |
| 4,439,507 | 3/1984 | Pan et al. | 430/66 |
| 4,532,166 | 7/1985 | Thomsen et al. | 428/57 |
| 4,786,570 | 11/1988 | Yu et al. | 430/64 |
| 4,801,517 | 1/1989 | Frechet et al. | 430/73 |
| 4,806,443 | 2/1989 | Yanus et al. | 430/66 |
| 4,806,444 | 2/1989 | Yanus et al. | 430/66 |
| 4,937,117 | 6/1990 | Yu | 428/57 |
| 5,021,109 | 6/1991 | Petropoulos et al. | 156/137 |
| 5,021,309 | 6/1991 | Yu | 430/56 |
| 5,030,532 | 7/1991 | Limburg et al. | 430/73 |
| 5,240,532 | 8/1993 | Yu | 156/137 |
| 5,262,512 | 11/1993 | Yanus et al. | 430/56 |
| 5,571,590 | 11/1996 | Schulz et al. | 428/57 |
| 5,582,949 | 12/1996 | Bigelow et al. | 430/132 |
| 5,606,396 | 2/1997 | Yu et al. | 399/162 |
| 5,698,358 | 12/1997 | Yu | 430/127 |
| 5,714,290 | 2/1998 | Yu et al. | 430/56 |
| 5,718,959 | 2/1998 | Wieloch et al. | 428/58 |
| 5,997,974 | 12/1999 | Schlueter et al. | 430/56 |
| 6,197,461 * | 3/2001 | Foltz et al. | 430/56 |

* cited by examiner

*Primary Examiner*—Janis L. Dote
(74) *Attorney, Agent, or Firm*—Oliff & Berridge, PLC

(57) ABSTRACT

Multiple-seam electrostatographic imaging member belts include two or more imaging member portions joined together by two or more seams. The belts can be formed from imaging member web that either includes or does not include an anti-curl backing layer, and that includes a charge transport layer that is substantially stress free.

15 Claims, 3 Drawing Sheets

MULTIPLE-SEAM ELECTROSTATOGRAPHIC IMAGING MEMBER AND METHOD OF MAKING ELECTROSTATOGRAPHIC IMAGING MEMBER

This is a Division of Application Ser. No. 09/449,342 filed Nov. 24, 1999, now U.S. Pat. No. 6,197,461. The entire disclosure of the prior application(s) is hereby incorporated by reference herein in its entirety.

BACKGROUND OF THE INVENTION

1. Field of Invention

This invention relates to electrostatographic imaging members.

2. Description of Related Art

Flexible electrostatographic imaging members include, for example, electrophotographic imaging members or photoreceptors for electrophotographic imaging systems, and electroreceptors or ionographic imaging members for electrographic imaging systems.

Flexible electrostatographic imaging members include a substrate and layers formed on the substrate. Photographic imaging members or photoreceptors comprise a substrate and a plurality of layers formed on the substrate. Typically, a charge transport layer, a charge generation layer, an adhesive layer and a charge blocking layer are formed on one side of the substrate, and an anti-curl backing layer is formed on the opposite side of the substrate. Electrographic imaging members include a substrate and typically also an electrically conductive layer and an insulative imaging layer formed over the substrate.

The imaging member material or web for forming electrostatographic imaging members is provided in rolls. The rolls are cut into sheets for forming electrostatographic imaging members. The sheets are typically square or rectangular shaped and have various lengths depending on the intended use of the sheets. Prior to cutting the roll into individual sheets, the web is inspected for defects by a detecting device, such as a light-emitting scanner. The scanner scans the web for the presence of internal defects and/or surface defects. The defects may be small or large internal or surface defects. For example, small internal defects can be random, which large surface defects, such as coating defects, can extend over the entire length of the web.

SUMMARY OF THE INVENTION

In order to form defect-free electrostatographic imaging members that include only one seam, the roll must contain continuous lengths of the web that have a length equal to at least the desired length of the electrostatographic imaging member. The defect-free portions of the web having the desired length are identified by inspection and then cut from the roll in the form of sheets. The defect-free sheets that are cut from the roll are then formed into belts or other configurations. The belts are commonly formed by overlapping the opposed ends of the sheet and forming a joint to secure the opposite ends together. The joints can be formed, for example, by ultrasonic welding techniques. Ultrasonic welding operations form a seam "splash" adjacent to either side of the overlapping joint of the seam. The splash consists of a molten mixture of the materials forming the layers on the substrate.

The remainder of the roll of the web that includes defects, or that is free of defects but is too short to individually form a single-seam belt, has previously been discarded as waste material. Due to the cost of the web, this waste material constitutes a significant economic loss. Accordingly, there is a need for electrostatographic imaging members and processes of making these members that can use this material that would otherwise be wasted.

Another problem associated with known electrostatographic imaging members such as photoreceptor belts is cracking and/or delamination at the welded seams. This problem has become more important in more advanced, higher speed electrophotographic imagers that include a flexible belt. It has been found that in these imagers, cracking and/or delamination at the welded seam frequently occurs during electrophotographic imaging and/or cleaning belt cycling processes. Premature cracking of the charge transport layer has also been a problem in known imagers. Cracks that develop in the photoreceptor transport layer cause print defects in the final copy and therefore shorten the belt's targeted service life. Cracking and/or delamination at the seam creates deposition sites at which debris can collect and also adversely affects cleaning of the belt.

Under dynamic fatigue loading conditions existing in electrophotographic imagers, the junction where the splash edge meets the charge transport layer surface provides a focal point for stress concentration and becomes a point of mechanical integrity failure in the photoreceptor belt. Dynamic fatigue at this stress concentration point facilitates tear initiation through the charge transport layer to form a vertical crack. This crack then propagates horizontally through the weak charge generating layer/adhesive layer interface bond to produce local seam delamination.

In addition, in known photoreceptor belts, seams fabricated by ultrasonic welding have an excessive seam overlap thickness and large splashes, which interfere with cleaning operations, accelerate cleaning blade wear, affect photoreceptor belt motion quality and disturb toner image acoustic transfer assist device operations. Such known photoreceptor belts are also prone to develop charge transport layer cracking and belt ripples.

Known photoreceptors normally include an anti-curl backing layer to counteract curling of the web. However, the anti-curl backing layer can cause problems in fabricated photoreceptor belts. These problems include that known photoreceptor belts contain a substantial amount of built-in internal tensile strain in the charge transport layer due to the counter balancing force exerted by the anti-curl backing layer coating to offset the curl. Belt ripples can form during operation of the belts and prevent uniform contact between receiving sheets and toner images carried on the surface of the photoreceptor belt for complete toner image transfer, thereby adversely affecting the quality of the final copy print-outs. Moreover, belt ripples also can significantly reduce the efficiency of cleaning blade function, which in turn is detrimental to the formation of high quality images in the final print copies.

Photoreceptors having an anti-curl backing layer have also been found to have reduced resistance to the onset of cyclic fatigue charge transport layer cracking during cycling over belt support rollers. Fatigue bending strain over belt support rollers during dynamic photoreceptor belt machine cycling, causes cracking development in the charge transport layer as well as seam cracking/delamination, which shortens the service life of the photoreceptor belt.

Moreover, the anti-curl backing layer also increases the volume of molten mass ejection during the ultrasonic seam welding process of the overlap joint to produce a larger splash.

Although the foregoing description refers in detail to electrophotographic imaging members or photoreceptors, the problems described also can occur in electrographic imaging members.

This invention provides electrostatographic imaging members formed from electrostatographic imaging member material, or web, that prior to this invention was discarded as waste material.

This invention separately provides multiple-seam, electrostatographic imaging members that comprise two or more sheets and also two or more seams at which the sheets are joined together.

This invention separately provides multiple-seam, electrostatographic imaging members that comprise seams located in the imaging member at regions that are not imaged.

This invention separately provides methods of making electrostatographic imaging members from web that prior to this invention was discarded as waste material.

This invention separately provides methods of making electrostatographic imaging members that comprise inspecting a supply of web, identifying defect-free portions of the web that have a length that is less than the length of an electrostatographic imaging member to be formed from the web, and forming an imaging member by joining together at least two of these defect-free web portions.

This invention separately provides methods of forming electrostatographic imaging members comprising two or more sheets of web and two or more seams joining the sheets together.

This invention separately provides methods of forming images using the multiple-seam, electrostatographic imaging members.

This invention separately provides multiple-seam, electrostatographic imaging members that do not include an anti-curl backing layer.

This invention separately provides multiple-seam, electrostatographic imaging members that include a charge transport layer having improved resistance to fatigue cracking during extensive imaging cycling.

This invention separately provides multiple-seam, electrostatographic imaging member belts having reduced seam thickness and reduced seam splash.

This invention separately provides multiple-seam, electrostatographic imaging member belts including a welded seam having improved resistance to cracking/delamination failure during belt cycling.

This invention separately provides multiple-seam, electrostatographic imaging member belts having increased resistance to ripple formation during operation.

This invention separately provides methods for treating webs of flexible multiple-seam electrostatographic imaging member material that promote belt cycling life extension. The methods can be used to treat flexible webs that do not include an anti-curl backing layer, as well as flexible webs that include an anti-curl backing layer.

This invention separately provides methods for forming flexible multiple-seam electrostatographic imaging member belts that include multiple seams from the flexible webs that do not include an anti-curl backing layer, as well as from flexible webs that include an anti-curl backing layer.

Exemplary embodiments of the electrostatographic imaging members according to this invention comprise a first imaging member portion including a first end and a second end opposite to the first end, and a second imaging member portion including a first end and a second end opposite to the first end. The first end of the first imaging member portion and the second end of the second imaging member portion are joined together to form a first seam. The second end of the first imaging member portion and the first end of the second imaging member portion are joined together to form a second seam. In embodiments, the first and second seams can be substantially identical.

Exemplary multiple-seam photoreceptor belts according to the invention can comprise a first belt portion having first and second ends, and a second belt portion having first and second ends. Each of the first and second ends of the second belt portion are joined to one of the first and second ends of the first belt portion. Each of the first belt portion and the second belt portion include a support substrate and a charge transport layer formed over the support substrate. The charge transport layer includes an outer portion that is substantially stress free when placed into an arcuate shape.

The first and second imaging member portions can have various lengths that are less than the length of the web that would be needed to form a single-seam belt electrostatographic imaging member.

In exemplary embodiments of the electrostatographic imaging members according to this invention, at least two of the seams are spaced from each other by a distance sufficient to provide at least one imaging zone between the two seams.

Exemplary embodiments of the methods of forming a multiple-seam electrostatographic imaging member according to this invention comprise inspecting an electrostatographic imaging member web to identify portions of the web that are free of defects and sufficiently long to provide at least one imaging zone to accept the width of a receiving sheet, cutting the web to remove the defect-free portions, and joining at least two of the defect-free portions together to form an electrostatographic imaging member. Ends of the defect-free portions of the web are joined together to form an electrostatographic imaging member having two or more seams.

In some exemplary embodiments, the flexible photoreceptor webs do not include an anti-curl layer. The charge transport layers in the photoreceptor webs are substantially free of transverse internal tension strain, thereby effecting the removal of belt edge curl and providing improved belt edge flatness.

In some exemplary embodiments of the processes of this invention, flexible multiple-seam electrostatographic imaging belts are fabricated from an electrostatographic imaging member web without an anti-curl layer, which is treated according to exemplary embodiments of the processes of this invention.

Exemplary embodiments of the processes of this invention provide flexible, multiple-seam, electrostatographic imaging belts that comprise a flexible support substrate and at least one coating layer. The webs of some exemplary embodiments do not include an anti-curl backing layer. Some of the exemplary embodiments include a processing step that is performed off-line on web stock material after forming the coating layer.

BRIEF DESCRIPTION OF THE DRAWINGS

The preferred embodiments of this invention will be described in detail, with reference to the following figures, in which.

DETAILED DESCRIPTION OF PREFERRED EMBODIMENTS

Figure 1:
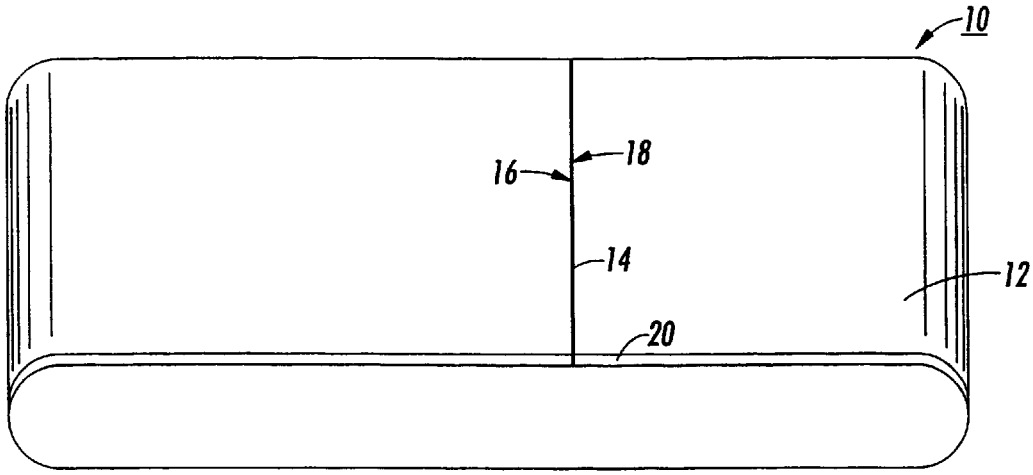
FIG. 1 (PRIOR ART)
FIG. 1 illustrates a conventional single-seam, electrostatographic imaging member belt.

FIG. 1 illustrates a known electrostatographic imaging member belt 10. The belt comprises a single sheet 12 of defect-free web and a single seam 14 formed by joining together the opposed ends 16 and 18 of the sheet together. Accordingly, the single-seam belt 10 is formed from a continuous sheet of defect-free web having a length equal to the length of the belt 10. A ground strip 20 is formed at one edge of the belt 10 to provide electrical contact during belt cyclic imaging function.

However, supplies of electrostatographic imaging member material or web, typically in the form of rolls, commonly include portions that include defects in addition to defect-free portions. The defects can affect the physical, mechanical and/or electrical properties of the web, and thus make the defect-containing portions unsuitable for forming imaging members. Consequently, the portions of the roll that include unacceptable defects, and also the portions of the roll that are defect-free, but are too short to individually form into the single-seam belt 10, cannot be used for this purpose. These defective or short portions of the roll have prior to this invention normally been discarded as waste.

This invention addresses the problem of waste of electrostatographic imaging member web material. Particularly, this invention provides multiple-seam belts that can be formed by joining together defect-free portions of electrostatographic imaging member web that are too short to form the single-seam belt 10.

Figure 2:
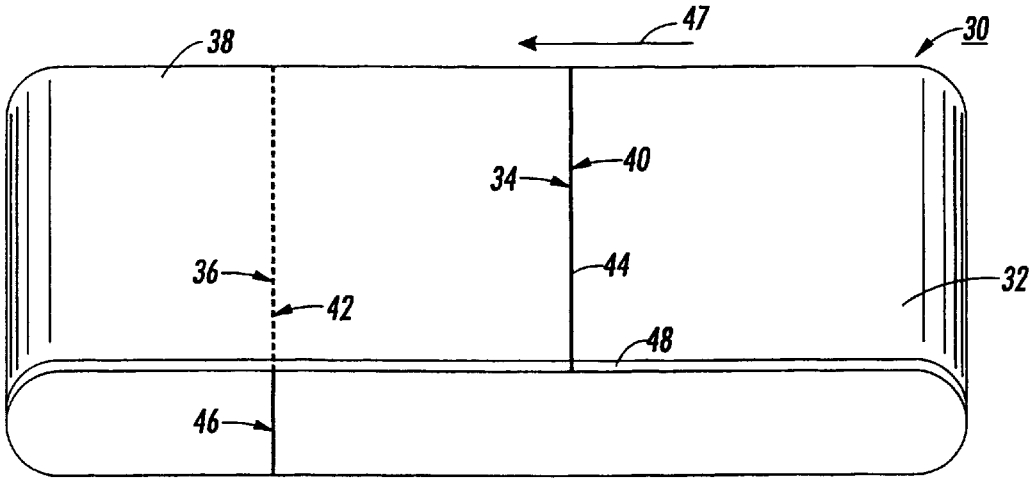
FIG. 2 illustrates an exemplary embodiment of a multiple-seam, electrostatographic imaging member belt according to this invention.

FIG. 2 shows a multiple-seam, electrostatographic imaging member belt 30 according to an exemplary embodiment of this invention. The belt 30 comprises a first belt portion or first sheet 32 having a first end 34 and a second end 36, and a second belt portion or second sheet 38 having a second end 40 and a first end 42. The first end 34 and the second end 40 of the respective first belt portion 32 and second belt portion 38 are joined together to form a first seam 44. The second end 36 and the first end 42 of the respective first belt portion 32 and second belt portion 38 are joined together to form a second seam 46. The multiple-seam belt 30 includes a ground strip 48 at one edge of the belt 30.

In other embodiments of the invention, the belt 30 may include more than two seams, such as three, four or more seams.

As stated above, the imaging member web for forming the belt 30 is typically provided in the form of rolls. The rolls are cut into sheets of the desired length, such as the first and second belt portions 32 and 38, to form the belt 30. The sheets are typically square or rectangular shaped. The sheets may have various lengths depending on the total length of the belt 30. Each sheet has a length at least sufficient to accommodate the width of a toner image receiving sheet. For example, the belt 30 may have a total length of from about 0.5 meters (1.6 ft) to about 4 meters (13 ft).

The first and second belt portions 32 and 38 are both defect-free portions removed from a supply of imaging member web. These each have a length that is less than the total length of the belt 30. Thus, these first and second belt portions 32 and 38 cannot individually be used to form a belt having the same length as the belt 30 and only a single seam, such as the belt 10 shown in FIG. 1. These first and second belt portions 32 and 38 would normally have been discarded as waste web material in known processes of forming electrostatographic imaging members prior to this invention, assuming the first and second belt portions 32 and 38 could not be used to form some other type of imaging member that has a shorter length than the belt 30. Thus, this invention advantageously can utilize imaging member web material that, although it is defect-free, would otherwise have been discarded as waste prior to this invention.

In various exemplary embodiments, the belt 30 is formed by joining together the first and second belt portions 32 and 38 by forming the first seam 44 and the second seam 46 using any suitable technique. For example, the first and second seams 44 and 46 can be formed by ultrasonic welding, gluing, taping, stapling and pressure and heat fusing.

Figure 3:
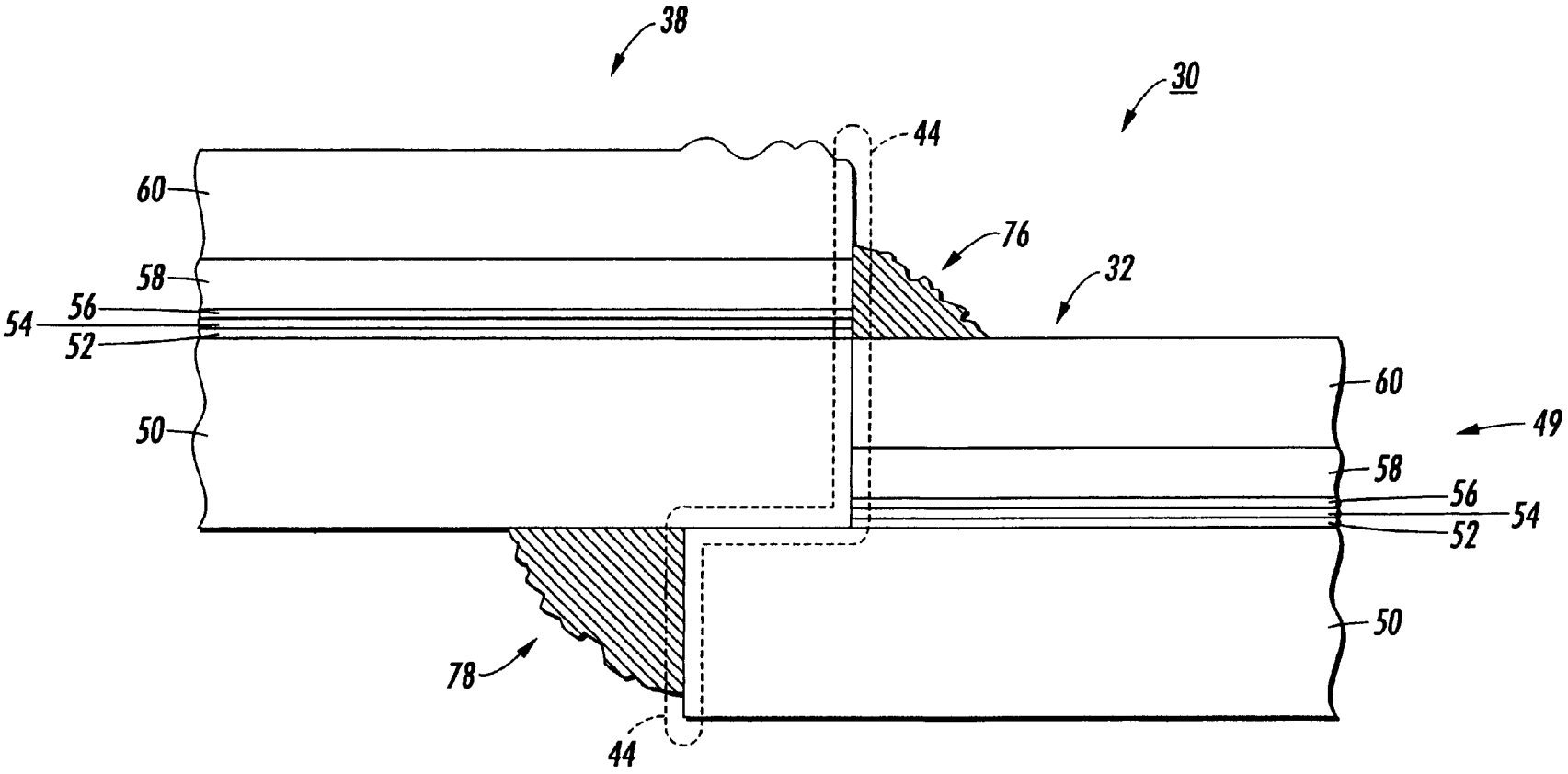
FIG. 3 is a side partial cross-sectional view of an exemplary embodiment of a seam region of photoreceptor belt of this invention having no anti-curl layer and including a stress-released charge transport layer formed according to an exemplary embodiment of the processes of this invention.

In various exemplary embodiments, the belt 30 can be formed from any suitable defect-free portions of electrostatographic imaging member material. FIG. 3 illustrates an exemplary embodiment of the first seam 44 formed between the first belt portion 32 and the second belt portion 38 of the belt 30. The second seam 46 has the same configuration as the first seam 44 and is not also illustrated for simplicity.

In various exemplary embodiments, the first belt portion 32 and the second belt portion 38 of the belt have respective lengths so that the first seam 44 and the second seam 46 are spaced from each other in the process direction 47 by a distance equal to at least the maximum size of an image that can be formed on the belt 30. Also, the first seam 44 and the second seam 46 are spaced from each other by a sufficient distance to accommodate the width of a imaging receiving sheet, so that the seams do not appear as a printout defect.

Alternatively, suitable distances between the first seam 44 and the second seam 46 can be determined based on the physical dimensions of the imaging apparatus in which the belt 30 is installed. For example, for imaging apparatus that include a platen, the dimensions of the platen determine the maximum size of images that can be formed by the imaging apparatus. Accordingly, the platen dimensions can also be considered in determining suitable distances between the first seam 44 and the second seam 46. In addition, the specifications of peripheral components of the imaging system can also be used to select a suitable spacing range between the first seam 44 and the second seam 46. For example, the printing capabilities of printers associated with the imaging apparatus determine the size of receiving sheets that can be used with the printers. Accordingly, the seam spacing can be selected to enable printing on sheets that can be printed by the printer.

In various exemplary embodiments of the belt 30 that include three or more seams, at least two adjacent seams are spaced from each other in the process direction 47 by a distance equal to at least the size of a maximum image that can be formed on the belt 30. In some embodiments, each of the seams can be located on the belt to enable printing between each adjacent pair of seams.

Accordingly, various exemplary embodiments of the electrostatographic imaging members according to this invention can avoid imaging problems by only forming images on portions of the imaging members between seams, and not forming images at the locations of seams.

As shown in the exemplary embodiment of a seam in FIG. 3, the first belt portion 32 and the second belt portion 38 each comprise a photoreceptor 49 including a support substrate 50 and multiple layers 52, 54, 56, 58 and 60 formed over the substrate 50. These layers include an electrically conductive layer 52, a charge blocking layer 54, an adhesive layer 56, a charge generating layer 58 and a charge transport layer 60.

The exemplary embodiment of the belt 30 shown in FIG. 3 does not include an anti-curl layer. Electrostatographic imaging members that have been subjected to a stress relief process and do not include an anti-curl layer are described in U.S. Pat. No. 6,165,670, which is incorporated herein by reference in its entirety.

By eliminating the need for an anti-curl layer in exemplary embodiments of the belt 30, the first seam 44 has a reduced overlap thickness and also a smaller upper seam splash 76 and lower seam splash 78, as formed by ultrasonic welding processes. Particularly, the first seam 44 configuration, and also the second seam 46 configuration, have a high seam rupture strength, which results from the first and second seams 44 and 46 being formed from the photoreceptor 49 that includes no anti-curl backing layer. Consequently, one less layer is melted during the joining process used to form the welded seams 44 and 46. The provision of improved seams having smaller dimensions, reduced seam splash, and improved mechanical properties is particularly advantageous in the belt 30 because it includes at least two seams.

Suitable support substrates 50 and layers 52, 54, 56, 58 and 60 are described in detail in incorporated U.S. Pat. No. 6,165,670. Support substrate 50 can be opaque or substantially transparent, and can comprise any suitable photoreceptor substrate material having the desired properties. The support substrate 50 comprises a layer of an electrically non-conductive or conductive material, of an inorganic or an organic composition. Exemplary electrically non-conducting materials that can be used to form the substrate 50 are described in incorporated U.S. Pat. No. 6,165,670.

Depending on various considerations, including mechanical properties such as beam strength, and also economic considerations, the support substrate 50 can have a thickness ranging, for example, from about 50 $\mu$m to about 175 $\mu$m. In various exemplary embodiments of a flexible photoreceptor 49 used to form the belt 30, such as shown in FIG. 3, the thickness of the support substrate 50 is between about 65 $\mu$m and about 150 $\mu$m, and desirably between about 75 $\mu$m and about 100 $\mu$m, for optimum flexibility and minimum stretch when cycled around small diameter rollers, e.g., 19 mm diameter rollers.

The electrically conductive layer 52 can comprise any suitable electrically conductive material and can be formed over the support substrate 50 by any suitable coating technique. Suitable exemplary materials, thickness ranges and processes for forming the electrically conductive layer 52 are described in incorporated U.S. Pat. No. 6,165,670.

After forming the electrically conductive layer 52, the charge blocking layer 54 can be applied over the electrically conductive layer 52. The charge blocking layer 54 can comprise any suitable material capable of forming an electronic barrier to holes between the adjacent photoconductive layer and the underlying electrically conductive layer 52. Suitable compositions, thickness ranges and processes for forming the charge blocking layer 54 are described in incorporated U.S. Pat. No. 6,165,670.

The adhesive layer 56 is optional and can be applied over the charge blocking layer 54. Exemplary suitable adhesive layer materials, thickness ranges and processes for forming the adhesive layer 56 are described in incorporated U.S. Pat. No. 6,165,670.

Any suitable photogenerating layer material can be applied over the adhesive layer 56 to form the charge generating layer 58. Suitable photogenerating layer materials, thickness ranges and processes for forming the charge generating layer 58 are described in U.S. Pat. No. 6,165,670.

In addition, suitable compositions, thickness ranges and processes for forming the charge transport layer 60 are described in incorporated U.S. Pat. No. 6,165,670.

The photoreceptor 49 used to form the belt 30 can optionally include other layers, such as a conventional electrically conductive ground strip 20, 48 shown in FIGS. 1 and 2, respectively, along one edge of the photoreceptor belt 30 in contact with the electrically conductive layer 52, charge blocking layer 54, adhesive layer 56 or charge generating layer 58, to facilitate connection of the electrically conductive layer 52 of the photoreceptor 49 of the belt 30 to ground or to an electrical bias.

In exemplary embodiments of the multi-seam electrographic imaging members of this invention, a flexible dielectric layer overlying the electrically conductive layer 52 and the flexible support substrate 50 can be substituted for the active photoconductive layers, such as, for example, the charge generating layer 58 and the charge transport layer 60. Any suitable flexible, electrically insulating material can be used in the dielectric layer of these exemplary embodiments of the electrographic imaging member.

In exemplary embodiments of the processes of forming electrostatographic imaging members, such as the belt 30, the photoreceptor 49 of original imaging member webstock having no anti-curl coating and exhibiting upward imaging web curling is cut to form sheets of the photoreceptor 49, such as the belt first portion 32 and the second belt portion 38. For example, the webstock can be cut to form rectangular or other desirably shaped photoreceptor cut sheets. The imaging member cut sheets are each rolled up, in the longer dimension direction with the charge transport layer 60 facing outwardly, into tubes such as 1½ inch, 1 inch, ¾ inch and ½ inch tubes. These tubes are then placed in a heated environment, such as in an air circulation oven, at a suitable temperature for stress relief processing to eliminate the need of an anti-curl backing layer. The temperature selection is dependent on the glass transition temperature of the materials forming the charge transport layer 60. A typical temperature selection is about 90° C., i.e., about 7° C. above the glass transition temperature of the charge transport layer, applied for a suitable amount of time to heat the charge transport layer 60 to a temperature above its glass transition temperature. Although the heat exposure time required for a rolled up photoreceptor tube to reach the temperature of the heated environment depends on the mass of the photoreceptor tube, a typical time for this heating process is about two minutes.

After being heated to a temperature above the glass transition temperature, the rolled up photoreceptor tubes are subsequently cooled to a temperature below the glass transition temperature. Typically, the tubes are cooled to about room ambient temperature to stress relieve the charge transport layer.

As stated, the elimination of an anti-curl backing layer in the photoreceptor 49 decreases its overall thickness, and reduces induced bending stress when the fabricated belt 30 flexes over belt support module rollers during imager operation. Consequently, the onset of charge transport layer 60 cracking due to fatigue cycling is significantly extended. Furthermore, the absence of an anti-curl backing layer at the seam 44 leads to a decrease in seam overlapped region thickness as well as the reduction in volume of the molten mass ejection from the overlapped joint to form the seam splashes 76 and 78 during the ultrasonic seam welding process. In addition, thinner seam overlap coupled with smaller seam splashes can effect the suppression of the fatigue seam cracking and/or delamination problem that occurs in known seamed belts.

Exemplary embodiments of the processes of treating electrostatographic imaging member webs of this invention comprise treating of the flexible photoreceptor 49 of an imaging member webstock to achieve stress relief of the charge transport layer 60. Stress relieving the charge transport layer 60 eliminates the need for an anti-curl backing layer as described above. The process comprises bending the entire photoreceptor 49 web of the imaging member webstock, with the charge transport layer 60 facing outwardly, in an arc having an imaginary axis which traverses the width of the photoreceptor 49. The arc axis is substantially perpendicular to the longitudinal direction of the long edges of the photoreceptor 49 web. The arc is visible when viewing the edge of the photoreceptor 49 in a direction perpendicular to the longitudinal direction of the long edges of the web.

In the multiple-seamed belt 30, prepared from the photoreceptor 49 web having no anti-curl backing layer according to exemplary embodiments of the process of this invention, the thickness of the seams 44 and 46 is substantially reduced and the size of the seam splashes 76 and 78 is reduced, as compared to seamed belts having an anti-curl backing layer 30. As a consequence, the reduced thickness of the seams 44 and 46 with smaller splashes 76 and 78 reduces mechanical interaction against cleaning blades, acoustic transfer assist devices, and other interacting subsystems function, as well as suppresses seam cracking and/or delamination failure problems of the seams 44 and 46 when the belt 30 flexes over small diameter support rollers during electrophotographic imaging and cleaning processes. Furthermore, the thinner configuration of the photoreceptor 49 coupled with stress release in the charge transport layer 60 through the process of this invention can significantly extend the fatigue cycling life of the belt 30 over small diameter belt support rollers without encountering premature cracking or liquid-developer-exposure-induced cracking of the charge transport layer 60 during bending.

Figure 4:
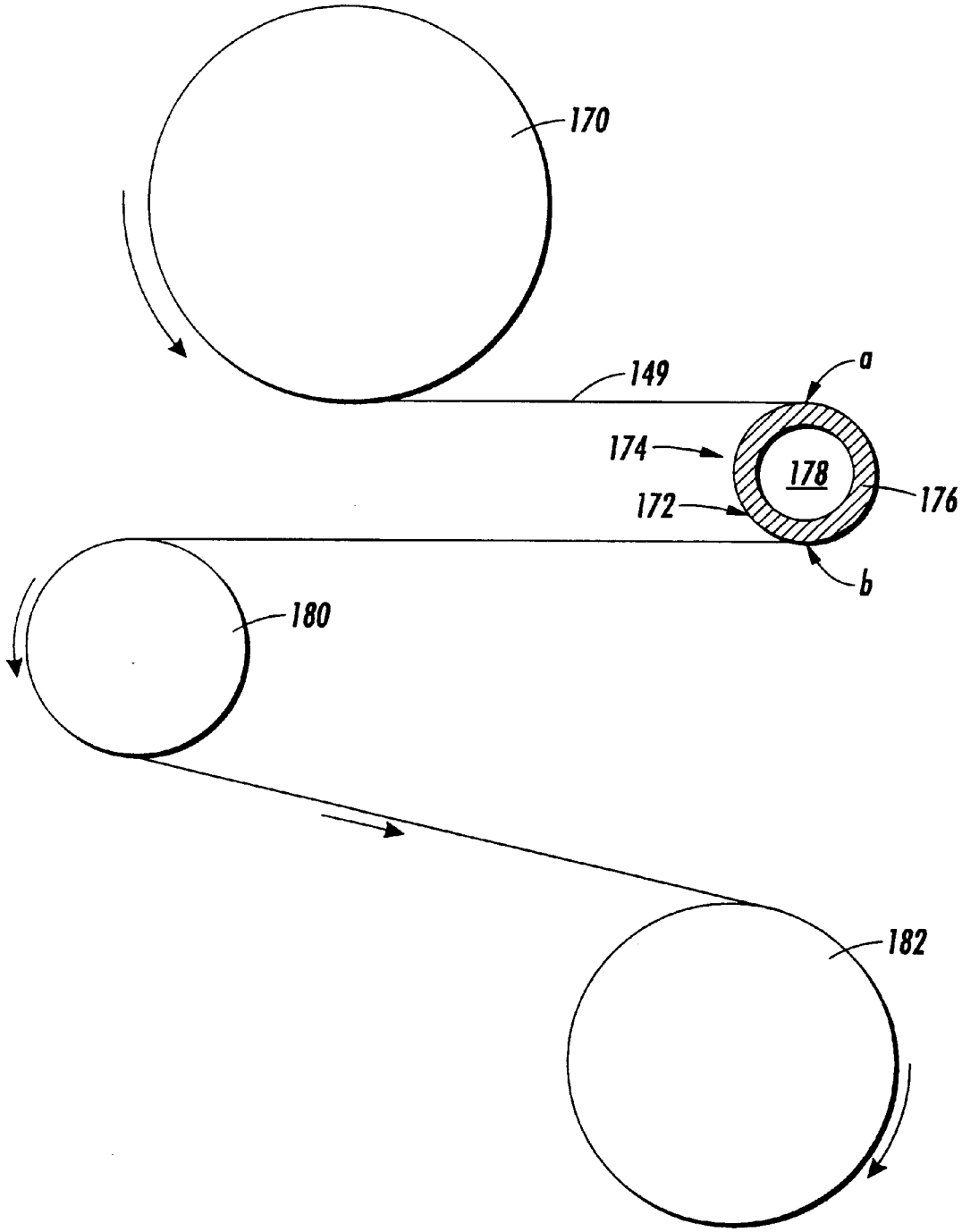
FIG. 4 is a schematic illustration of an exemplary embodiment of a stress release treatment method according to this invention, in which an electrophotographic imaging member roll-up supply web, having no anti-curl backing layer, is subjected to a heating and cooling treatment process.

FIG. 4 shows an exemplary embodiment of a process of this invention for treating a flexible, electrostatographic imaging member web 149, having no anti-curl backing layer. As stated, the imaging member web 149 can either be an electrophotographic or electrographic imaging member web. The electrographic imaging member web comprises an imaging layer.

This process is performed to relieve the internal stress and/or strain in the charge transport layer in the photoreceptor 149 for electrophotographic imaging member web treatment, and to relieve internal stress/strain in the imaging layer for electrographic imaging member web treatment as well. However, for simplicity, the process will be described with respect to the treatment of an electrophotographic imaging member web 149 having the same structure as the photoreceptor 49 shown in FIG. 3.

Referring to FIG. 4, the imaging member web 149 is unwound from a roll of webstock 170 so that the charge transport layer 60 faces outwardly. The imaging member web 149 is transported over a treatment processing tube's surface which bends the imaging member web 149 into an arc shape. The arcuate surface can be the arcuate outer surface 172 of the treatment processing tube 174. The outer surface 172 has a circular cross-section. The processing tube 174 includes an annular shell 176 and an inner chamber 178. As shown, the imaging member web 149, having no anti-curl backing layer, is bent into the arc shape and conformed to the outer surface 172 of the processing tube 174, as transported and then parked over the processing tube 174; in this manner, the imaging member web 149 makes contact with the outer surface 172 of the processing tube 174 over an angular range between the points a and b. This illustrated angular range is about 180°, or $\pi$ radians.

The angular range of contact of imaging member web 149 with the outer surface 172 is not, however, limited to about 180°. The angular range of contact can range from about 90° to a wrapped angle slightly less than 360° in exemplary embodiments of the process of this invention.

In addition, the arcuate surface over which the imaging member web 149 is bent into an arc is not limited to semi-circular surfaces, such as that illustrated in FIG. 4, of the outer surface 172. For example, the arcuate surface can alternatively have other like shapes such as oblong circular cross-sectional shapes.

Furthermore, the processing tube 174 can be rotatable or non-rotatable. Exemplary embodiments of rotatable processing tubes 174 can be driven by a suitable drive such as a motor. Alternatively, the rotatable processing tube 174 can be freely rotatable about an axis, such that the processing tube is rotated by the interfacial frictional force generated by the movement of the imaging member web 149 as it is transported over the outer surface 172.

The processing tube 174 provides the treatment functions of heating and cooling the imaging member web 149 when it is stopped in the parked state over the processing tube 174. The annular shell 176 of the processing tube 174 is heated to a selected temperature by a suitable heating source, so that the outer surface 172 in contact with the imaging member web 149 heats the imaging member web 149. For example, a heated fluid can be flowed through the inner chamber 178 of the processing tube 174 to heat the annular shell 176 as well as its outer surface 172 to heat the segment of the imaging web that is parked directly over the processing tube 174. The fluid can be a gas or a liquid. Typically, water or super heated water or steam is preferred because it has a suitably large heat capacity.

In order to provide suitable heating of the imaging member web 149, the processing tube 174 is formed of a material that has good thermal conductivity. Suitable materials for the processing tube 174 include, for example, metals such as aluminum and copper.

It will be understood by those skilled in the art that the processing tube 174 can alternatively be heated by other energy sources than such heated fluids. For example, the processing tube 174 can be heated by passing a sufficient current through the annular shell 176 to heat the annular shell 176 to the desired temperature.

The heated outer surface 172 heats the imaging member web 149 such that the temperature of the charge transport layer 60 is raised to a temperature that is at least about several degrees above the glass transition temperature of the material forming the charge transport layer 60. For example, the charge transport layer 60 is desirably heated to a temperature that is about 4–10° C. above the glass transition temperature. The glass transition temperature of the charge transport layers of known electrophotographic imaging members may be in a range from about 45° C. to about 150° C. depending on the material forming the charge transport layer. However, a typical charge transport layer has a glass transition temperature, Tg, of about 85° C. Accordingly, the outer surface 172 of the processing tube 174 can be heated to raise the charge transport layer 60 temperature to from about 89–95° C. Heating the charge transport layer 60 above about 95° C. does not provide any significant additional benefits and, accordingly, is less desirable.

For known electrographic imaging members, the glass transition temperature Tg of the imaging layers is between about 100° C. and about 170° C. Typical known imaging layers have a glass transition temperature Tg of about 156° C.

Typically, the imaging member web 149 has a thickness of about 0.08 mm to about 0.2 mm. Such thicknesses of the imaging member web 149 can be rapidly heated so that the charge transport layer 60 temperature reaches a suitable temperature in less than about 1 second, which is typically achieved in significantly short times. Because the imaging member is very thin, for example 0.106 mm in thickness, and has a small mass, the heating up of this imaging member web segment that is parked over the tube 174 to the equilibrium temperature of the heating fluid will typically take only about 0.125 second.

After the charge transport layer 60 is heated to the desired temperature above the glass transition temperature, the imaging member web 149 is then cooled to a temperature below the glass transition temperature Tg. To achieve this cooling, the processing tube 174 can be cooled by introducing a cooled fluid into the inner chamber 178 of the processing tube 174. The cooled fluid cools the annular shell 176, which then decreases the temperature of charge transport layer 60 down to the desired low temperature below its glass transition temperature Tg. The charge transport layer 60 is substantially stress free as conformed in the arcuate shape. Typically, the charge transport layer 60 is cooled down to about room ambient temperature. Desirably, the charge transport layer 60 is cooled quickly to the desired low temperature. Such quick cooling can increase processing efficiency and thereby reduce the cycle-time of the treating process.

The cooled imaging member web 149 is subsequently advanced by a distance equal to the distance between points a and b to effect the next cycle of the imaging member segmental treatment process. After the treatment cycle, the imaging member web 149 is then moved over an arcuate surface of a roller such as the free rotation idle roller 180, to change the web's transporting direction, and then wound onto a take-up roll 182.

By advancing the imaging member web 149 by this distance, a new segment of the imaging member web 149 to be subjected to the heating and cooling process is moved so that it contacts the outer surface 172 of the processing tube 174 between the points a and b. The movement of the imaging member web 149 is stopped so this new segment is parked directly over the processing tube 174. This new segment is then subjected to the heating and cooling treatment cycle as described above.

The above-described heating and cooling process is repeated until the desired portion, typically the entire length of the imaging member web 149, has been treated to at least substantially remove the internal cross-web (transverse) stress/strain from the charge transport layer 60. First and second imaging member portions are cut from the treated electrostatographic imaging member web. The first and second imaging member portions are joined together to make a multi-seam electrostatographic imaging member belt.

The processing tube 174 for the stress-release treatment depicted in FIG. 4 has an diameter that can range from about 0.5 inch to about 1.5 inch. A diameter of from about 0.5 inch and about 0.75 inch is particularly preferred because it has been found to give excellent results. A processing tube 174 outer diameter of from about 0.5 inch to about 1.5 inch is suitable for the treating imaging member web 149 having a broad range of thicknesses, such as from about 0.08 mm to about 0.2 mm.

Because the above-described heating and cooling process for the imaging member web 149 at least substantially removes the internal transverse tensile stress/strain from the charge transport layer 60, the outermost charge transport layer 60 of the imaging member does not exert a tension pulling force from both imaging member web edges toward the center, which thereby eliminates the current imaging member belt edge curl problem. That is, the charge transport layer 60 is substantially stress/strain free in the cross web direction to render transverse direction imaging member belt flatness. The charge transport layer can be considered as in a substantially stress/strain free state when its internal strain is reduced to a level not more than 0.01% after the imaging member has been subjected to the above-described treatment process according to this invention.

In exemplary embodiments of the process of this invention, electrographic imaging member webs can also be treated by the above-described heating and cooling process to substantially eliminate transverse tensile stress in the imaging layer, so as to provide improved flatness.

Although the above description of exemplary embodiments of the electrostatographic imaging member and methods of making the electrostatographic imaging member of this invention referred specifically to only electrophotographic imaging members, the embodiments of this invention can also be used for electrographic imaging members as well.

While the invention has been described in conjunction with the specific embodiments described above, it is evident that many alternatives, modifications and variations are apparent to those skilled in the art. Various changes can be made without departing from the spirit and scope of the invention.

What is claimed is:

1. A method of making a multiple-seam electrostatographic imaging member belt, comprising:

joining together a first end of a first imaging member portion and a second end of a second imaging member portion to form a first seam; and joining together a second end of the first imaging member portion and a first end of the second imaging member portion to form a second seam.

2. The method of claim 1, wherein joining the first and second imaging members comprises forming the first and second seams by ultrasonic welding.

3. The method of claim 1, wherein the first imaging member portion and the second imaging member portion are each free of defects.

4. The method of claim 1, wherein the first imaging member portion and the second imaging member portion each comprise an electrostatographic imaging member web that does not include an anti-curl backing layer.

5. The method of claim 4, wherein the electrostatographic imaging member web is an electrophotographic imaging member web that comprises at least a charge transport layer.

6. The method of claim 4, wherein the electrostatographic imaging member web is an electrographic imaging member web that comprises an imaging layer.

7. The method of claim 1, further comprising:

providing an electrostatographic imaging member webstock including a support substrate and a charge transport layer formed over the support substrate, the charge transport layer comprising a polymeric material having a glass transition temperature; and treating the electrostatographic imaging member webstock by a process including:

moving the electrostatographic imaging member webstock into contact with and parked over a surface to form a portion of the electrostatographic imaging member webstock into an arcuate shape, the charge transport layer disposed outwardly from the support substrate relative to the surface;

heating the charge transport layer of the portion of the electrostatographic imaging member webstock to a temperature at least about several degrees above the glass transition temperature of this portion while the portion of the electrostatographic imaging member webstock is in the arcuate shape;

cooling the portion of the electrostatographic imaging member webstock to a temperature below the glass transition temperature of the charge transport layer while in the arcuate shape, so that the charge transport layer of this portion is substantially stress free as conformed in the arcuate shape;

repeating the treating process to treat the entire electrostatographic imaging member webstock; and cutting the first and second imaging member portions from the treated electrostatographic imaging member webstock.

8. The method of claim 7, wherein the surface has a circular cross-sectional shape.

9. The method of claim 7, wherein the first portion of the electrostatographic imaging member webstock is heated and cooled by respectively heating and cooling the surface.

10. The method of claim 9, wherein the surface is an outer surface of a hollow roller, the hollow roller including an annular shell and an inner chamber, the surface is heated and cooled by introducing a heated fluid and a cooled fluid, respectively, into the inner chamber.

11. The method of claim 7, wherein the surface has a circular cross-sectional shape and a diameter of from about 0.5 in to about 1.5 in, the electrostatographic imaging member web has a thickness of from about 0.08 mm to about 0.2 mm, and the first portion of the electrostatographic imaging member web makes parking contact with the surface over an angular range of between about 90° and less than about 360°.

12. A multiple-seam electrostatographic imaging member belt made according to the method of claim 7.

13. A multiple-seam photoreceptor belt, comprising:

a first belt portion having first and second ends;

a second belt portion having first and second ends, each of the first and second ends of the second belt portion joined to one of the first and second ends of the first belt portion;

wherein each of the first belt portion and the second belt portion include:

a support substrate, and a charge transport layer formed over the support substrate, the charge transport layer including an outer portion, wherein the outer portion of the charge transport layer is substantially stress free when placed into an arcuate shape.

14. The multiple-seam photoreceptor belt of claim 13, wherein the first belt portion and the second belt portion each do not include an anti-curl backing layer.

15. The multiple-seam photoreceptor belt of claim 13, wherein the first belt portion and the second belt portion each include an anti-curl backing layer.

* * * * *